US005096003A

United States Patent [19]

Kinnan

[11] Patent Number: 5,096,003

[45] Date of Patent: * Mar. 17, 1992

[54] METHOD AND APPARATUS FOR SUBSOIL DRILLING

[76] Inventor: Frank R. Kinnan, 570 Baldwin Rd., Camas Valley, Oreg. 97416

[ * ] Notice: The portion of the term of this patent subsequent to Sep. 18, 2007 has been disclaimed.

[21] Appl. No.: 670,744

[22] Filed: Mar. 15, 1991

[51] Int. Cl.[5] ..... E21B 7/06; E21B 7/18

[52] U.S. Cl. ..... 175/61; 175/67; 175/73; 175/320; 175/324; 175/424

[58] Field of Search ..... 175/61, 67, 73-75, 175/231, 256, 267, 320, 324, 424

[56] References Cited

U.S. PATENT DOCUMENTS

| | | | |
|---|---|---|---|
| 2,345,766 | 4/1944 | Miller | 175/256 |
| 2,643,859 | 6/1953 | Brown | 175/73 |
| 3,199,615 | 8/1965 | Storm | 175/73 |
| 3,457,999 | 7/1969 | Massey | 175/256 X |
| 4,286,676 | 9/1981 | Nguyen et al. | 175/320 X |
| 4,597,454 | 7/1986 | Schoeffler | 175/61 |
| 4,790,394 | 12/1988 | Dickinson et al. | 175/67 X |
| 4,899,835 | 2/1990 | Cherrington | 175/74 |
| 4,957,173 | 9/1990 | Kinnan | 175/61 |

*Primary Examiner*—Hoang C. Dang

[57] ABSTRACT

A method and apparatus for creating an underground bore hole employing a steerable boring head at the end of a remotely driven drill string. The boring head, preformed at an angle to the longitudinal axis of the trailing pipe string to bore along a curvilinear path is straightened by increasing the pressure of the fluid within the drill string above a predetermined range to enable drilling along a linear path. Subsequent reduction of the fluid pressure to normal drilling pressure returns the boring head to its former state along a resumption of a curvilinear drill path.

12 Claims, 2 Drawing Sheets

METHOD AND APPARATUS FOR SUBSOIL DRILLING

BACKGROUND OF THE INVENTION

1. Field of the Invention

The invention is directed to the field of subsurface drilling with the use of high pressure fluid for installing, below ground, various utility items such as electrical cable, conduit, water pipes, sewer pipes and the like.

2. Description of the Prior Art

An excellent device for providing underground bore holes is disclosed and claimed in U.S. Pat. No. 4,957,173 issued Sept. 18, 1990 by Frank R. Kinnan and entitled "METHOD AND APPARATUS FOR SUBSOIL DRILLING" and assigned to the assignee of the instant invention.

As is shown in FIGS. 1 and 2 of the instant application, which are FIGS. 2 and 3 of the above-cited patent, a drilling and steering assembly 20 permits linear boring as long as the pressure of the viscous drilling fluid supplied from the trailing pipe string 18 is at or about a first predetermined level. As soon as that level is exceeded, the excess pressure acts upon a piston 55 coupled to a push rod 50 to deflect or bend steering mechanism 40 from a position aligned with its longitudinal axis as shown in FIG. to a position displaced from such axis as shown in FIG. 2. Once the change in direction of the pipe string has been accomplished, fluid pressure is reduced and the steering mechanism is allowed to return to its aligned position and boring is recommenced.

In order that maximum flexibility of steering mechanism 40 is achieved, a section 44 of tube 41 must be removed which naturally weakens the tube 41. The flexure of steering mechanism 40 for long periods of time as where a wide or long curved bore is required strains the tube 41 and can result in its premature failure.

SUMMARY OF THE INVENTION

The present invention overcomes the possible problems that can be created when the device of the above-identified patent is used often or for long periods of time to produce curved bores.

The present invention uses a steering mechanism which is preformed into an angled configuration with respect to the longitudinal axis of the drill pipe string and which, upon the application of drilling fluid at a pressure above that required for boring, straightens out to a configuration generally linear and aligned with the drill pipe string longitudinal axis, to permit linear drilling.

It is a principal object of the invention to provide an improved steering mechanism which employs a fluid jet, which is in parallel alignment with the longitudinal axis of the nose member, to create a bore and a rotating, forward-driven length of drill pipe to propel the nose assembly containing the jet along such a bore, while utilizing the fluid flow also to effect a positive steering effect on the boring head by controlling the deflection of said steering mechanism from a preformed angled configuration.

It is still another object of the invention to provide a remotely operated steering mechanism for a fluid operated subsoil penetration tool having few moving parts and providing positive steering in response to the variation of pressure of the high pressure fluid flowing through the pipe string.

Other objects and features of the invention will be pointed out in the following description and claims and illustrated in the accompanying drawings, which disclose, by way of example, the principles of the invention and the best mode which has been presently contemplated for carrying them out.

BRIEF DESCRIPTION OF THE DRAWINGS

In the drawings, in which similar elements are given similar reference characters.

Figure 3:
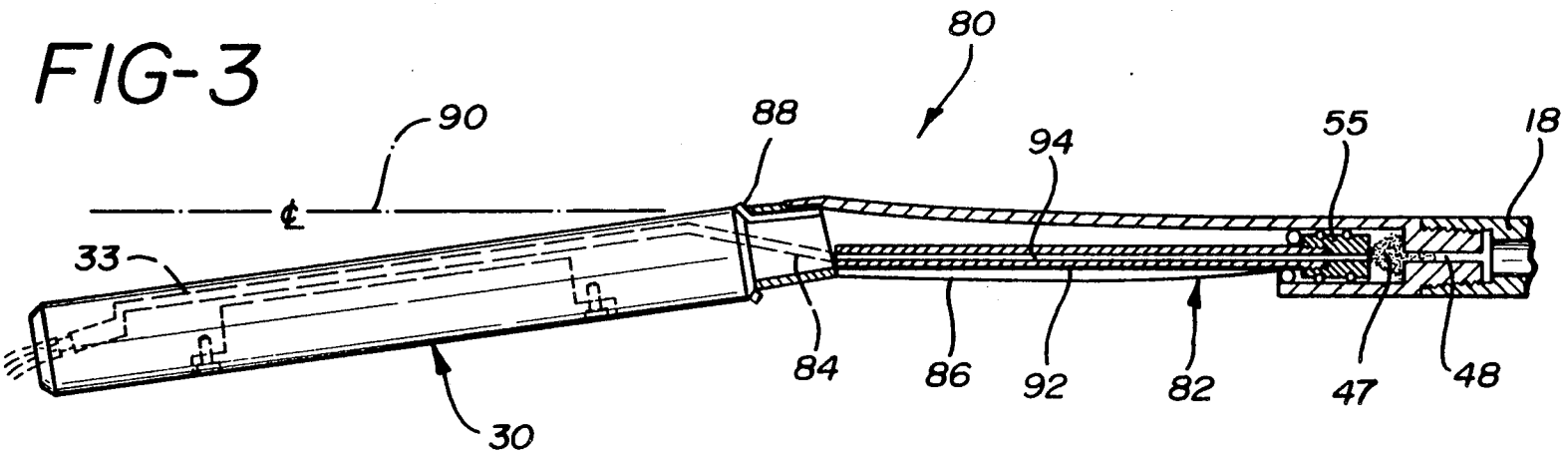
FIG. 3 is a side view of the nose assembly and steering section, in section, of the present invention, in the normal drilling position.

FIG. is similar to FIG. 3, but illustrating the positions of the nose assembly and steering section operated for linear movement along the trailing drill pipe string longitudinal axis.

Figure 1:
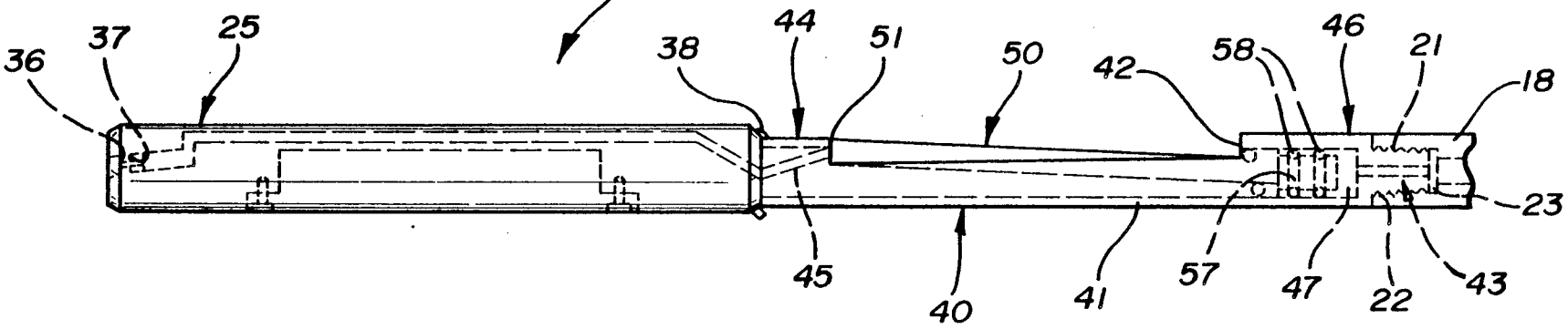
FIG-1 PRIOR ART
FIG. 1 is a side view of the nose assembly and steering section of the device of U.S. Pat. No. 4,957,173 issued Sept. 18, 1990 and is FIG. 2 of that patent and shows the device in its normal drilling position.
Figure 2:
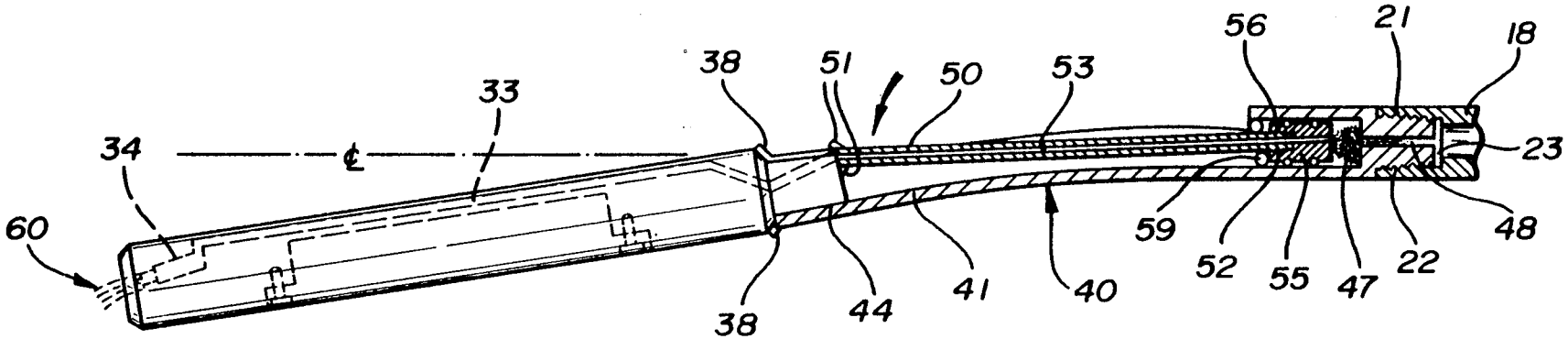
FIG-2 PRIOR ART
FIG. 2 is similar to FIG. 1, but with portions of the steering mechanism cut away, and illustrating the parts in position for turning or changing direction and is FIG. 2 of the '173 patent.

Turning now to FIGS. 1 and 2, the drilling and steering assembly 20 of the above-identified patent is shown. Assembly 20 is threaded upon the end of pipe string 18 by means of internal thread 21 of pipe 18 and male threaded end 22 of tube 41. A coupling may be inserted between the last drill pipe and the boring head to match the threads if required. Fluids such as water or a water/Betonite slurry or other conventional cutting fluids, supplied at pressures of about 1500 to 2000 pounds per square inch, pass through pipe 18, passage 53 in steering mechanism 40, passage 35 and passage 33 in nose member 30 and exit through the carbide inserts 36, 37 of nozzles 35(*a*) and 35(*b*) which direct the fluid jet in parallel to the longitudinal axis of nose member 30, to disturb and displace the subsoil and permit the creation of the bore hole by the advancing assembly 20. As long as the fluid flow is such that it can pass through the nozzles without creating a back-up in the passageway 33, the assembly 20 continues to move along the longitudinal axis of the trailing drill string as rotated and advanced by drill pipe string 18.

Increases in pressure above normal operating pressures will create a back pressure in chamber 47 which will cause movement of piston 55 in chamber 47 to the left in FIG. 2. The movement of the piston 55 causes push rod 50 to also move to the left causing tube 41 to bend downwardly as in FIG. 2. The degree of movement will depend upon the increase in pressure over normal operating pressures. Assuming push rod 50 is steel having an outside diameter of ½ inch and a 3/16ths inch passage 53 therethrough, the carbide inserts 36, 37 each have an orifice of 0.015 inches, a pressure increase to 3000 PSI will effect about a ¾ inch deflection of the nozzle end of the nose member 30, while an increase in pressure to about 4000 PSI will effect a deflection of about 1 ½ inches of nose member 30.

To produce a long sweeping curve to pass about an object in the bore hole path or to return to the surface after boring under buried objects, it is necessary or desirable to have the assembly 20 follow a curved path. This can be achieved by flexing steering mechanism 40 a great number of times so that the straight drilling sections approximate a curve. This continual flexing of steering mechanism places a great deal of strain on the stainless steel tube 41 which is weakened by removing section 44 to give it greater flexibility. Even when operated without flexure, the weakened tube 41 is subject to metal fatigue failure. To facilitate the cutting of a bore hole in a curvilinear fashion, the drilling and steering assembly 80 of the present invention employs a steering mechanism 82 where tube 86 is preformed such that nose member 30 joined to tube 86, as at welds 88, in its non-operated state, is at an acute angle to the longitudinal axis in center line 90. Push rod 92 is repositioned to the lower portion of tube 86 and its passage 94 is made to communicate with passage 33 in nose portion 30 by means of passage 84.

Fluids are introduced via drill pipe 18, passage 48 to chamber 47. As long as the pressure of the fluids introduced are below that which can be emitted by the nozzles at the distal end of nose member 30, tube 86 will retain its shape as shown in FIG. 3, positioning nose member 30 in such a manner as to bore a curvilinear bore hole.

Figure 4:
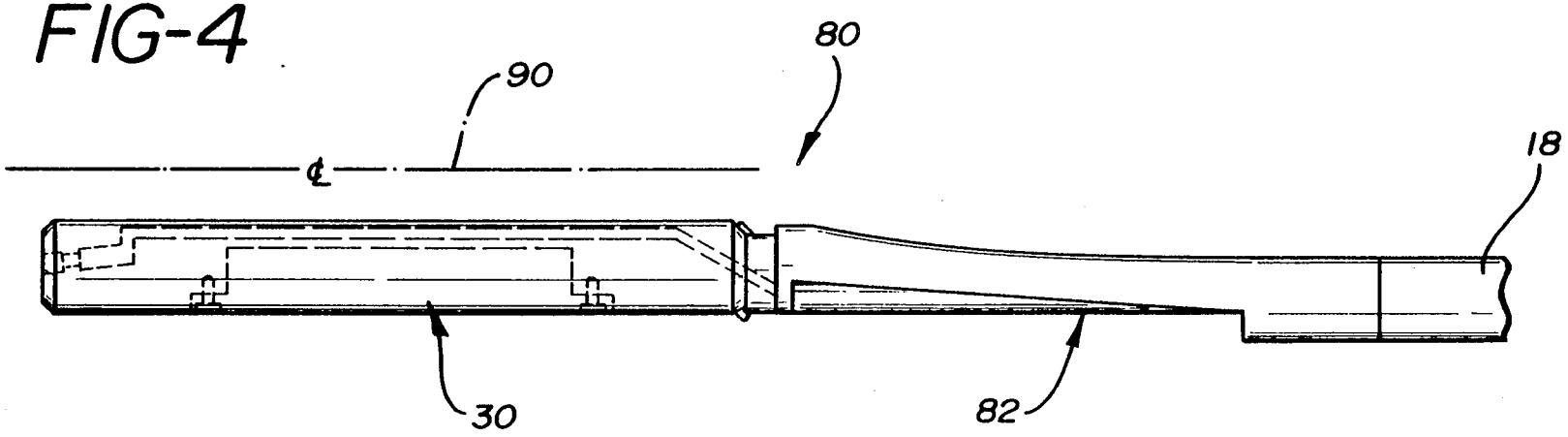

By increasing the pressure of the fluids above such level, a back pressure will be created in passage 33 which will create a pressure behind piston 55 forcing it to the left in FIG. 3. As a result, push rod 92 will also be forced to the left causing the nose member 30 to be rotated in a clockwise direction to assume a position along the longitudinal axis or center line 90 as shown in FIG. 4. The movement of the drilling and steering assembly 80 would now be along a straight line coaxial with longitudinal axis 90. Reduction of the pressure of the applied fluids would allow assembly 80 to return to its offset position as shown in FIG. 3.

While there has been shown, described and pointed out the fundamental novel features of the presentation invention as applied to the preferred embodiment, it will be understood that various changes in the form and details of the devices illustrated and in their operation may be made without departing from the spirit and scope of the invention.

What is claimed is:

1. A steering mechanism for a subsoil drilling tool comprising:

a nose member having a passageway therethrough and a nozzle means to eject viscous fluid in parallel alignment with the axis of the nose member therefrom;

steering means comprising a bendable member for supporting the nose member and having a longitudinal axis and having a first and a second end, said bendable member extending at an angle to said longitudinal axis and said first end having operatively connected to said nose member, and said second end being configured for operative connection to a string of trailing hollow drill members;

a rod coupled between the first and second ends of the bendable member, said rod including a passage therethrough in communication with both said drill string and said nose member such that viscous fluid under a given pressure may flow therethrough;

said steering means including means responsive solely to an increase in the given pressure of the viscous fluid flowing into said steering means from said drill string to force said bendable member to bend into alignment with said longitudinal axis and ,thereby effect a change in direction of said nose member and thereby the following drill string.

2. The mechanism of claim 1, wherein said means responsive to said increase in pressure for causing said steering means to bend comprises:

said rod extending substantially between said first end and said second end of said steering means;

means fixedly attaching one end of said rod to one end of said steering means; and means for moveably attaching said rod at the other end to the other end of said steering means such that said change in the given fluid pressure effects a bending movement of said bendable member by longitudinally moving said rod.

3. The mechanism of claim 2, wherein said rod is fixed near said first end of said bendable member and is movable longitudinally relative to said second end of said bendable member.

4. The mechanism as set forth in claim 3, wherein said bendable member includes a tube-like member which is configured and arranged to permit flexure.

5. The mechanism of claim 4, wherein said second end of said tube-like member is formed to provide a chamber therein for receiving the fluid under pressure and the other end of said rod is configured as a piston disposed within said chamber, whereby when said increase in pressure is received within said chamber, said piston is moved towards said first end of said tube-like member thereby causing said rod to apply a bending movement to said tube-like member.

6. The mechanism of claim 1, further including:

an orifice of predetermined diameter in said nose member to permit only limited fluid flow therethrough for the given fluid pressure such that an increase in the given fluid pressure causes an increase in the fluid pressure upstream of said orifice; and piston means in said steering means upstream of said orifice and responsive solely to said increase in the given fluid pressure to effect longitudinal movement of said rod to cause the bending movement of said bendable member.

7. The mechanism of claim 6, wherein said orifice of predetermined diameter causing the back pressure is disposed within said nozzle means at the terminal end of said nose member.

8. The mechanism set forth in claim 6, wherein said orifice is disposed at the first end of said steering means.

9. The mechanism of claim 4, wherein said tube-like member is configured and arranged to provide flexure by having portions thereof removed between said first and second ends thereof.

10. The mechanism of claim 1, wherein said means responsive to said increase in the given fluid pressure for causing said bendable member to bend comprises means for effecting longitudinal movement of said rod in response to the increased pressure change in the fluid so as to free said bendable member to bend.

11. A steering mechanism for a subsoil drilling tool coupled to a source of viscous fluid comprising:

a nose member having a passageway therethrough and nozzle means to permit a viscous fluid to be emitted therefrom;

said nozzle means being provided at its free end with an orifice of predetermined diameter permitting only limited fluid flow therethrough corresponding to a predetermined pressure such that an increase in the pressure of fluid arriving thereat would cause an increase in fluid pressure upstream of said orifice;

steering means comprising a bendable member having a longitudinal axis and a first and a second end, said bendable member extending at an angle to said longitudinal axis and said first end being operably connected to said nose member and said second end being adapted for operative connection to a string of trailing hollow drill members;

said steering means including a fluid passage therethrough in communication both with said drill string and said nose member whereby viscous fluid may flow through said nozzle means orifice;

said bendable member including a tubular member having portions thereof removed between said first and second ends whereby such tubular member is bendable;

said steering means further including a hollow rod extending between said first end of said tubular member and a chamber disposed within said tubular member near said second end thereof;

said rod being provided with a piston adjacent to one end thereof for slideable movement in said chamber and being fixed at the other end thereof to the first end of said tubular member; and said chamber being in communication with said passageway through said rod and through said second end of said tubular member whereby an increase of fluid pressure at said chamber will cause said piston to move within said chamber and thereby cause said rod to bend said bendable member into alignment with said longitudinal axis and effect a steering action on said steering mechanism.

12. A method of drilling an underground bore hole comprising the steps of:

providing a nose assembly having a nozzle means to eject a pattern of viscous fluid to disturb and displace subsoil thereby cutting a bore in a first direction;

connecting said nose assembly through a bendable mechanism having a longitudinal axis to a length of trailing drill pipe, said bendable mechanism including a bendable member extending at an acute angle to said longitudinal axis and a rod having a passage extending therethrough in fluid communication with the drill pipe and the nose assembly, said rod having one end fixedly connected to one end of the bendable member and the other end slideably connected to the other end of the bendable member;

providing to said nose assembly viscous fluid at a first predetermined pressure while simultaneously rotating trailing said drill pipe to effect a cutting action through said subsoil; and intermittently terminating said rotating action and increasing said predetermined fluid pressure of said viscous fluid to a second predetermined pressure to effect a change in the cutting direction of said nozzle means and said trailing pipe by moving said other end at the rod relative to the bendable member thereby bending said bendable member in alignment with said longitudinal axis and thereafter reducing the pressure of said viscous fluid to said first predetermined pressure whereby said bendable member will relax and return to its angled configuration with respect to said longitudinal axis and thereafter effecting rotation of said drill pipe with said fluid flow at said first predetermined pressure to continue cutting said bore.

* * * * *

UNITED STATES PATENT AND TRADEMARK OFFICE

CERTIFICATE OF CORRECTION

PATENT NO. : 5,096,003

DATED : March 17, 1992

INVENTOR(S) : Frank R. Kinnan

It is certified that error appears in the above-identified patent and that said Letters Patent is hereby corrected as shown below:

Column 2, line 22, "FIG." should read --FIG. 4--

Column 3, line 67, ",thereby" should read --thereby--

Signed and Sealed this

Twenty-fifth Day of May, 1993

*Attest:*

Michael K. Kirk

MICHAEL K. KIRK

*Attesting Officer*

*Acting Commissioner of Patents and Trademarks*